US011540685B2

(12) United States Patent
Shin et al.

(10) Patent No.: US 11,540,685 B2
(45) Date of Patent: Jan. 3, 2023

(54) NOZZLE FOR CLEANER, AND VACUUM CLEANER

(71) Applicant: LG ELECTRONICS INC., Seoul (KR)

(72) Inventors: Jinhyouk Shin, Seoul (KR); Ingyu Yang, Seoul (KR); Jungwan Ryu, Seoul (KR); Namil Woo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 471 days.

(21) Appl. No.: 16/473,197

(22) PCT Filed: Dec. 22, 2017

(86) PCT No.: PCT/KR2017/015407

§ 371 (c)(1),
(2) Date: Jun. 24, 2019

(87) PCT Pub. No.: WO2018/117763

PCT Pub. Date: Jun. 28, 2018

(65) Prior Publication Data

US 2019/0313867 A1 Oct. 17, 2019

(30) Foreign Application Priority Data

Dec. 23, 2016 (KR) ..... 10-2016-0177703

(51) Int. Cl.
*A47L 9/04* (2006.01)

(52) U.S. Cl.
CPC ..... *A47L 9/0477* (2013.01)

(58) Field of Classification Search
None
See application file for complete search history.

(56) References Cited

U.S. PATENT DOCUMENTS

| | | | |
|---|---|---|---|
| 10,092,153 | B2 | 10/2018 | Shim et al. |
| 2005/0039282 | A1 | 2/2005 | Paterson et al. |

(Continued)

FOREIGN PATENT DOCUMENTS

| | | |
|---|---|---|
| CN | 102068219 | 5/2011 |
| CN | 204734437 | 11/2015 |
| CN | 205514379 | 8/2016 |

(Continued)

OTHER PUBLICATIONS

CN205514379 Machine Translation, attached as pdf (Year: 2016).*

(Continued)

*Primary Examiner* — Brian D Keller
(74) *Attorney, Agent, or Firm* — Fish & Richardson P.C.

(57) ABSTRACT

A nozzle for a cleaner according to an aspect of the present invention comprises: a housing; and a rotation cleaning portion rotatably coupled to the housing and having a body part and a brush part which is coupled to the outer peripheral side of the body part. The brush part comprises: a first brush coupled to the outer peripheral side of the body part and extending in the radial direction of the body part; and a second brush disposed alongside the first brush. The first brush is disposed so as to come in contact with a floor surface prior to the second brush during the rotation of the rotation cleaning portion, and is less stiff than the first brush.

18 Claims, 4 Drawing Sheets

(56) References Cited

U.S. PATENT DOCUMENTS

| | | | | |
|---|---|---|---|---|
| 2016/0073841 | A1* | 3/2016 | Eriksson | A47L 9/322 15/344 |
| 2016/0278595 | A1 | 9/2016 | Shim et al. | |

FOREIGN PATENT DOCUMENTS

| | | | |
|---|---|---|---|
| EP | 0313403 | | 4/1989 |
| JP | H05317226 | | 12/1993 |
| JP | 07-059689 | A | 3/1995 |
| JP | H11318781 | | 11/1999 |
| JP | 2002112931 | | 4/2002 |
| JP | 2003-052584 | A | 2/2003 |
| JP | 2005-013319 | A | 1/2005 |
| JP | 2011-019819 | | 2/2011 |
| JP | 2015-171518 | A | 10/2015 |
| KR | 10-1644887 | B1 | 8/2016 |

OTHER PUBLICATIONS

JP2011019819 Machine Translation, attached as pdf (Year: 2011).*
Chinese Office Action in Chinese Appln. No. 201780049573.5, dated Jun. 2, 2020, 10 pages (with English translation).

* cited by examiner

NOZZLE FOR CLEANER, AND VACUUM CLEANER

CROSS-REFERENCE TO RELATED APPLICATIONS

This application is a National Stage application under 35 U.S.C. § 371 of International Application No. PCT/KR2017/015407, filed on Dec. 22, 2017, which claims the benefit of Korean Application No. 10-2016-0177703, filed on Dec. 23, 2016. The disclosures of the prior applications are incorporated by reference in their entirety.

TECHNICAL FIELD

The present invention relates to a nozzle of a cleaner and a vacuum cleaner.

BACKGROUND ART

In general, a vacuum cleaner is a device for sucking in air including dust using suction force generated by a suction motor installed in a cleaner body and then filtering out dust in a dust separation device. Such a vacuum cleaner is classified into a canister type cleaner including a suction nozzle provided separately from a body and connected thereto by a connection device to suck in dust, an upright type cleaner including a suction nozzle rotatably connected to a body, and a handy type vacuum cleaner used in a state in which a user grips a body by hand.

The suction nozzle of a conventional vacuum cleaner is provided with an agitator which is a rotary brush having bristles. The agitator is capable of performing cleaning while scraping dust on a floor or in a carpet.

Korean Patent Laid-Open Publication No. 10-2014-0123091 as a prior art document discloses a vacuum cleaner head.

The cleaner head of the prior art document includes a brush bar provided in a chamber and a motor for driving the brush bar. The motor rotates the brush bar, and the brush bar strikes a surface to be cleaned while the brush bar rotates. Accordingly, the brush bar is referred to as an agitator. The motor is inserted into the brush bar.

Meanwhile, in the cleaner head of the prior art document, the brush bar is provided with bristles to remove dirt adhered to a carpet, etc. However, a hair or a thread may be entangled with or wound on the brush bar, that is, a tangle may occur. Therefore, performance of the brush bar (or the agitator) may deteriorate.

DISCLOSURE

Technical Problem

An object of the present invention is to provide a nozzle of a cleaner and a vacuum cleaner, which are capable of preventing a phenomenon wherein a hair or a thread is wound on an agitator.

Another object of the present invention is to provide a nozzle of a cleaner and a vacuum cleaner, which are capable of easily cleaning a carpet.

Technical Solution

According to an embodiment of the present invention, a nozzle of a cleaner includes a housing, and an agitator rotatably coupled to the housing and including a body and a brush part coupled to an outer circumferential surface of the body, wherein the brush part includes a first brush coupled to the outer circumferential surface of the body and extending in a radial direction of the body and a second brush disposed in parallel with the first brush, wherein the first brush is disposed to be brought into a floor earlier than the second brush when the agitator rotates, and wherein the second brush has lower stiffness than the first brush.

Advantageous Effects

According to the present invention, a blocking member provided between stiff hairs and soft hairs of brushes can prevent a hair or a thread from being deeply entangled in the brushes. Therefore, it is possible to prevent a phenomenon wherein a hair or a thread is wound on the brushes.

In addition, the brushes of the present invention are disposed such that the stiff hairs are brought into contact with a surface to be cleaned earlier than the soft hairs, thereby easily removing contaminants upon cleaning a carpet. Accordingly, it is possible to further improve cleaning efficiency of an agitator.

BEST MODE

Exemplary embodiments of the present invention will be described below in detail with reference to the accompanying drawings in which the same reference numbers are used throughout this specification to refer to the same or like parts. In describing the present invention, a detailed description of known functions and configurations will be omitted when it may obscure the subject matter of the present invention.

It will be understood that, although the terms first, second, A, B, (a), (b), etc. may be used herein to describe various elements of the present invention, these terms are only used to distinguish one element from another element and essential, order, or sequence of corresponding elements are not limited by these terms. It will be understood that when one element is referred to as being "connected to", "coupled to", or "accessed to" another element, one element may be "connected to", "coupled to", or "accessed to" another element via a further element although one element may be directly connected to or directly accessed to another element.

Figure 1:
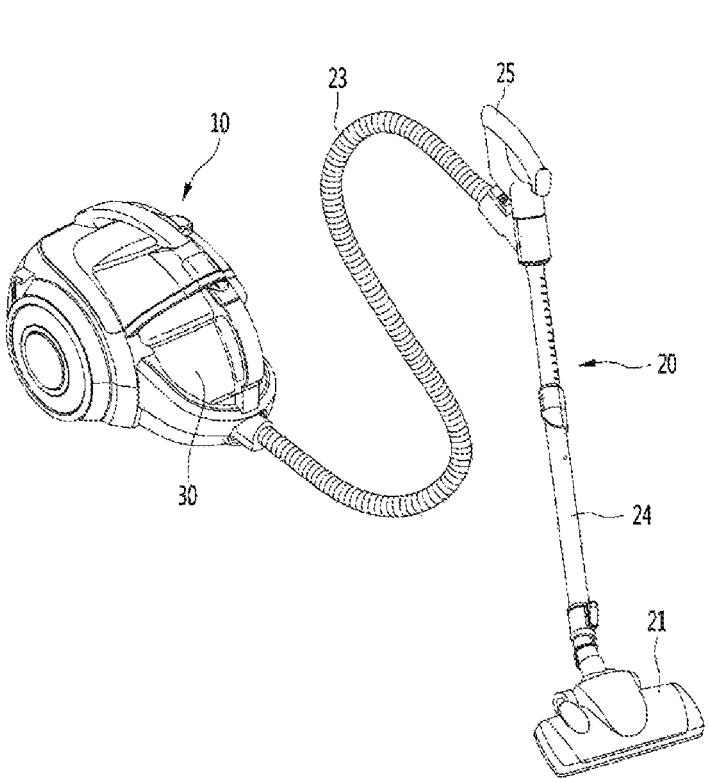
FIG. 1 is a perspective view of a vacuum cleaner according to an embodiment of the present invention.
Figure 2:
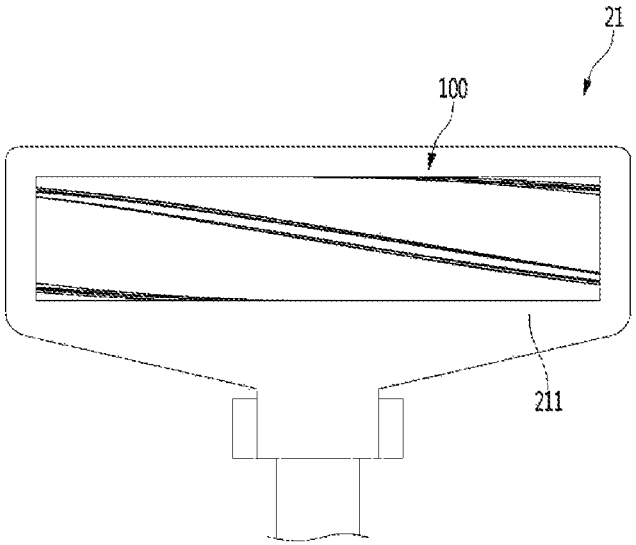
FIG. 2 is a bottom view of a suction nozzle of FIG. 1.

FIG. 1 is a perspective view of a vacuum cleaner according to an embodiment of the present invention, and FIG. 2 is a bottom view of a suction nozzle of FIG. 1.

Referring to FIGS. 1 and 2, the vacuum cleaner 1 according to the embodiment of the present invention may include a cleaner body 10 and a suction device 20 connected to the cleaner body 10.

The suction device 20 may include a suction nozzle 21 for sucking in dust on a surface to be cleaned, for example, a floor, and connection parts 23, 24 and 25 for connecting the suction nozzle 21 to the cleaner body 10.

The connection parts 23, 24 and 25 may include an extension pipe 24 connected to the suction nozzle 21, a handle 25 connected to the extension pipe 24 and a suction hose 23 for connecting the handle 25 to the body 10.

When a user rotates or moves the handle 25 back and forth or left and right in a state of gripping the handle 25, movement force of the handle 25 is transmitted to the suction nozzle 21 to move the suction nozzle 21 on the floor, thereby performing cleaning.

In addition, the vacuum cleaner 1 may further include a dust separator (not shown) for separating air and dust sucked in through the suction device 20 from each other and a dust container 30 for storing dust separated in the dust separator. The dust container 30 may be detachably mounted in the cleaner body 10. The dust separator may be manufactured as an article formed separately from the dust container 30 or may form a module with the dust container 30.

The vacuum cleaner 1 may further include an agitator 100 provided in the suction nozzle 21.

At least a portion of the agitator 100 is exposed to the bottom 211 of the suction nozzle 21. In addition, at least a portion of the agitator 100 may be brought into contact with the surface to be cleaned.

The agitator 100 may be rotatably mounted in the suction nozzle 21. In addition, a driver (not shown) such as a motor for providing power may be connected to the agitator 100. Accordingly, the agitator 100 may rotate by power from the driver. As the agitator 100 rotates at the time of cleaning, contaminants such as dust accumulated on the surface to be cleaned can be removed.

Hereinafter, the agitator 100 will be described in detail.

Figure 3:
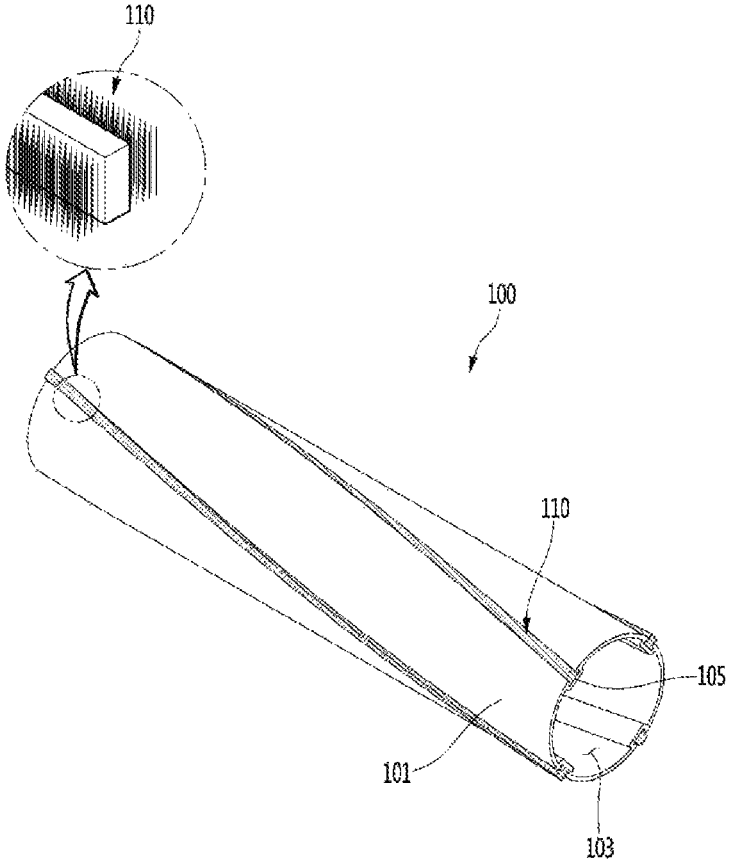
FIG. 3 is a perspective view of an agitator of FIG. 2.
Figure 4:
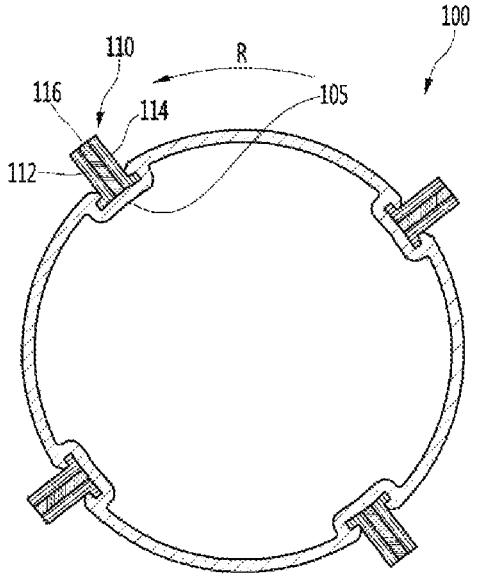
FIG. 4 is a side cross-sectional view of the agitator.

FIG. 3 is a perspective view of an agitator of FIG. 2, and FIG. 4 is a side cross-sectional view of the agitator.

Referring to FIGS. 3 and 4, the agitator 100 may include a cylindrical body 101.

An opening 103 may be formed in the body 101 along a longitudinal direction. A driver and a rotation support part may be inserted into the opening 103.

The agitator 100 includes a brush part 110 for removing contaminants on the surface to be cleaned. The brush part 110 may be coupled to the outer circumferential surface of the body 101. The brush part 110 may protrude from the outer circumferential surface of the body 101 outward.

Guides 105 for guiding coupling of the brush part 110 may be formed in the body 101. The guides 105 are recessed in the body 101 and are formed in a spiral shape. Although four guides 105 are provided in the body 101, without being limited thereto.

The brush part 110 may include a first brush 112 and a second brush 114.

The first brush 112 and the second brush 114 may be formed in parallel along the guides 105.

The first brush 112 may be made of a material having higher stiffness than the second brush 114. Specifically, the stiffness of the first brush 112 in the longitudinal direction is greater than that of the second brush 114 in the longitudinal direction. In addition, the first brush 112 has higher density than the second brush 114.

The first brush 112 may be made of bristles, stiff hairs, and the second brush 114 may be made of soft hairs. For example, the first brush 112 may include carbon fibers and the second brush 114 may be made of cotton threads.

The second brush 114 may be disposed behind the first brush 112 in the rotation direction R of the agitator 100. In the figure, the rotation direction R of the agitator 100 is a counterclockwise direction. Accordingly, when the agitator 100 rotates, the first brush 112 may be brought into contact with the surface to be cleaned earlier than the second brush 114.

Therefore, when the carpet is cleaned, the first brush 112 may easily remove contaminants adhered to the stiff hairs. That is, the first brush 112 may primarily remove contaminants adhered to the carpet and the second brush 112 may sweep the contaminants separated from the carpet. Accordingly, it is possible to efficiently clean the carpet.

The brush part 110 may further include a blocking member 116. The blocking member 116 may include a rubber material or may be made of a rubber material. Accordingly, the blocking member 116 is referred to as a rubber member.

The blocking member 116 may be disposed between the first brush 112 and the second brush 114. Accordingly, when the agitator 100 rotates, the blocking member 116 is brought into contact with the surface to be cleaned after the first brush 112 is brought into contact with the surface to be cleaned. In addition, the blocking member 116 is brought into contact with the surface to be cleaned earlier than the second brush 114.

By providing the blocking member 116 between the first brush 112 and the second brush 114, it is possible to prevent a hair or a thread from reaching the second brush 114. That is, the blocking member 116 serves to prevent a hair or a thread from being deeply entangled in the brush part 110.

The blocking member 116 prevents a hair or a thread from being entangled in the brush part 110, thereby preventing the hair or the thread from being wound on the agitator 100.

The above description is only illustrative of the technical idea of the present invention and those skilled in the art will appreciate that various modifications and variations can be made without departing from the essential characteristics of the present invention. The above exemplary embodiments are therefore to be construed in all aspects as illustrative and not restrictive. The scope of the invention should be determined by the appended claims and their legal equivalents, not by the above description, and all changes coming within the meaning and equivalency range of the appended claims are intended to be embraced therein.

The invention claimed is:

1. A nozzle of a cleaner comprising:

a housing; and an agitator rotatably coupled to the housing, the agitator including a body and a brush part coupled to an outer circumferential surface of the body, wherein the brush part includes:

a first brush coupled to the outer circumferential surface of the body, the first brush extending in a radial direction of the body and having a first stiffness, a second brush disposed in parallel with the first brush, the second brush having a second stiffness less than the first stiffness of the first brush, and a blocking member disposed in parallel with the first and second brushes, the blocking member being made of a rubber material and being disposed between the first brush and the second brush, wherein the body comprises a guide that is a recess defined between a first edge and a second edge of the outer circumferential surface of the body, that extends along the outer circumferential surface of the body, and that is configured to receive portions of the first brush, the blocking member, and the second brush, wherein the first brush, the blocking member, and the second brush are arranged along the guide and extend parallel to one another, wherein the first brush has a first straight side that faces and contacts a first surface of the blocking member, and a first bent side that is curved around the first edge of the outer circumferential surface of the body and that is inserted into a first end of the guide, and wherein the second brush has a second straight side that faces and contacts a second surface of the blocking member, and a second bent side that is curved around the second edge of the outer circumferential surface of the body and that is inserted into a second end of the guide.

2. The nozzle according to claim 1, wherein the brush part is disposed in a spiral shape along the outer circumferential surface of the body.

3. The nozzle according to claim 1, wherein the guide extends along the outer circumferential surface of the body in a spiral shape.

4. The nozzle according to claim 1, wherein the guide is one of a plurality of guides provided in the body, and wherein the plurality of guides are spaced apart from each other at a predetermined interval.

5. The nozzle according to claim 1, wherein a radial length of the blocking member in the radial direction is equal to a radial length of each of the first brush and the second brush in the radial direction.

6. The nozzle according to claim 1, wherein a circumferential thickness of the blocking member is constant from an inner end to an outer end of the blocking member along the radial direction.

7. The nozzle according to claim 1, wherein the first bent side and the second bent side extend in opposite directions from each other along the outer circumferential surface of the body.

8. The nozzle according to claim 1, wherein a circumferential width of the guide is greater than or equal to a sum of widths of the first brush, the blocking member, and the second brush.

9. The nozzle according to claim 1, wherein the blocking member has (i) a first surface that faces and contacts one side of the first brush and (ii) a second surface that faces and contacts one side of the second brush, the second surface being parallel to the first surface.

10. The nozzle according to claim 1, wherein the guide has a bottom surface that extends from the first end of the guide to the second end of the guide and that contacts bottom surfaces of the first brush, the blocking member, and the second brush.

11. The nozzle according to claim 1, wherein a circumferential width of the guide is equal to a sum of widths of the first brush, the blocking member, and the second brush, wherein the first bent side contacts the first edge of the outer circumferential surface of the body and the first end of the guide, and wherein the second bent side contacts the second edge of the outer circumferential surface of the body and the second end of the guide.

12. The nozzle according to claim 1, wherein the first edge of the outer circumferential surface of the body extends toward the second edge of the outer circumferential surface of the body and contacts the first straight side of the first brush, and wherein the second edge of the outer circumferential surface of the body extends toward the first edge of the outer circumferential surface of the body and contacts the second straight side of the second brush.

13. The nozzle according to claim 12, wherein the first edge of the outer circumferential surface of the body further contacts the first bent side of the first brush, and wherein the second edge of the outer circumferential surface of the body further contacts the second bent side of the second brush.

14. A vacuum cleaner comprising:

a cleaner body including a suction motor;

a suction nozzle connected to the cleaner body and configured to suction air by suction force generated by the suction motor; and an agitator rotatably coupled to the suction nozzle, the agitator including a body and a brush part coupled to an outer circumferential surface of the body, wherein the brush part includes:

a first brush coupled to the outer circumferential surface of the body, the first brush extending in a radial direction of the body and having a first stiffness, a second brush disposed in parallel with the first brush, the second brush having a second stiffness less than the first stiffness of the first brush, and a blocking member disposed in parallel with the first and second brushes, the blocking member being made of a rubber material and being disposed between the first brush and the second brush, wherein the first brush is configured to contact a floor before the blocking member and the second brush contact the floor based on the agitator rotating in a rotational direction, wherein the blocking member is configured to contact the floor before the second brush contacts the floor based on the agitator rotating in the rotational direction, wherein the body comprises a guide that is a recess defined between a first edge and a second edge of the outer circumferential surface of the body, that extends along the outer circumferential surface of the body, and that is configured to receive portions of the first brush, the blocking member, and the second brush, wherein the first brush, the blocking member, and the second brush are arranged along the guide and extend parallel to one another, wherein the first brush has a first straight side that faces and contacts a first surface of the blocking member, and a first bent side that is curved around the first edge of the outer circumferential surface of the body and that is inserted into a first end of the guide, and wherein the second brush has a second straight side that faces and contacts a second surface of the blocking member, and a second bent side that is curved around the second edge of the outer circumferential surface of the body and that is inserted into a second end of the guide.

15. The vacuum cleaner according to claim 14, wherein a radial length of the blocking member in the radial direction is equal to a radial length of each of the first brush and the second brush in the radial direction.

16. The vacuum cleaner according to claim 14, wherein a circumferential thickness of the blocking member is constant from an inner end to an outer end of the blocking member along the radial direction.

17. The vacuum cleaner according to claim 14, wherein a circumferential width of the blocking member is equal to a sum of widths of the first brush, the blocking member, and the second brush.

18. The vacuum cleaner according to claim 14, wherein the first bent side and the second bent side extend in opposite directions from each other along the outer circumferential surface of the body.

* * * * *